US011180276B1

(12) United States Patent
Wang

(10) Patent No.: US 11,180,276 B1
(45) Date of Patent: Nov. 23, 2021

(54) BARREL WITH REINFORCED BARREL RIM

(71) Applicant: Top Green World Packaging Co., Ltd., Gelu (CN)

(72) Inventor: Ling-da Wang, Gelu (CN)

(73) Assignee: TOP GREEN WORLD PACKAGING CO, LTD., Shanghai (CN)

( * ) Notice: Subject to any disclaimer, the term of this patent is extended or adjusted under 35 U.S.C. 154(b) by 0 days.

(21) Appl. No.: 16/869,241

(22) Filed: May 7, 2020

(30) Foreign Application Priority Data

May 1, 2020 (CN) ..... 202020708255.4

(51) Int. Cl.
*B65D 1/46* (2006.01)
*B65D 1/16* (2006.01)

(52) U.S. Cl.
CPC *B65D 1/46* (2013.01); *B65D 1/16* (2013.01)

(58) Field of Classification Search
CPC ..... B65D 81/3802; B65D 39/0088; B65D 39/0041; B65D 11/06; B65D 9/04; B65D 9/02; B65D 7/04; B65D 7/02; B65D 7/045; B65D 1/18; B65D 1/165; B65D 1/14; B65D 1/12; B65D 1/46; B65D 1/16
See application file for complete search history.

(56) References Cited

U.S. PATENT DOCUMENTS 1,041,347 A * 10/1912 Potter ..... B65D 7/045 220/4.06
4,357,902 A * 11/1982 Sheldon ..... A01K 63/02 119/202
5,033,520 A * 7/1991 Kuehmichel ..... B65F 1/1468 141/231
6,612,396 B1 * 9/2003 Chelminski ..... G01V 1/053 181/113
8,550,517 B1 * 10/2013 Bates ..... B66C 1/625 294/67.33
2013/0248407 A1 * 9/2013 Giles ..... B65D 45/18 206/499

* cited by examiner

*Primary Examiner* — Kareen K Thomas
(74) *Attorney, Agent, or Firm* — Muncy, Geissler, Olds and Lowe, P.C.

(57) ABSTRACT

The Utility Model discloses a barrel with reinforced barrel rim, comprising a barrel body, and a barrel rim upwards extending along the barrel body, wherein a clamping strip extruded from the barrel rim is set around the barrel rim on four sides, the four sides of the barrel rim above the clamping strip are inclined towards the center of the barrel rim, and when the angle between the clamping strip and the four sides of the barrel rim is defined to be A, A is greater than 90° and less than or equal to 135°. The barrel rim in this patent application is reinforced, the inclination design provides the barrel rim the guiding function that when the barrel cover is hung at the barrel rim on the production line, the barrel cover can fall towards the barrel rim along the inclination in a correct way so as to be convenient for the following press; besides, the inclination of the barrel rim can separate the stress of the barrel rim so that the barrel rim can bear more pressure and hardly be deformed when being pressed.

1 Claim, 2 Drawing Sheets

BARREL WITH REINFORCED BARREL RIM

TECHNICAL FIELD

The Utility Model relates to a barrel with reinforced barrel rim.

BACKGROUND TECHNOLOGY

With the popularization of automatic production technology, the barrel and the matched barrel cover are all produced on the production line. Barrels are conveyed one by one by the first conveying line positioned at the bottom, the barrel cover is conveyed by the second conveying line positioned above the first conveying line, and the tail end of the second conveying line is inclined, so that the barrel cover can be hung at the barrel rim in time, and then is conveyed through the pressing plate through the first conveying line for forced pressing, so that the barrel and the barrel cover can be connected and pressed tightly. However, in this automatic production line, the barrel rim is often pressed and deformed, and the barrel cover cannot be sealed and combined with the barrel rim. When the barrel cover is hung at the barrel rim, the barrel cover cannot be tilted according to the preset direction, and the barrel cover will deviate from or even separate from the barrel rim.

Therefore, the inventors have studied various types of barrel rims. It is found that the barrel rim of the existing barrel generally extends vertically upward from the barrel body, i.e. the four walls of the barrel rim are vertical to the barrel body. In order to be able to clamp the barrel cover, the barrel rim is specially provided with a clamping strip protruding out of the barrel rim for one circle, and it is unchanged that the four walls of the barrel rim are still vertical to the clamping strip.

For this reason, the inventor wants to make some improvements to the barrel rim in order to change the defects of the barrel in the production line.

Content of the Utility Model

In order to solve the defects of the above technology, the application provides a barrel with reinforced barrel rim, aiming at overcoming the problems that the existing barrel rim is too soft, easy to deform and cannot be guided.

In order to achieve the above technical purpose, the application adopts the following technical solution:

A barrel with reinforced barrel rim, comprising a barrel body, and a barrel rim upwards extending along the barrel body, wherein a clamping strip extruded from the barrel rim is set around the barrel rim on four sides, the four sides of the barrel rim above the clamping strip are inclined towards the center of the barrel rim, and when the angle between the clamping strip and the four sides of the barrel rim is defined to be A, A is greater than 90° and less than or equal to 135°.

Preferably, the edge of the barrel rim is chamfered.

Preferably, an inverted-triangle shaped reinforced bar is set on the inner side of the barrel rim and extends from the barrel rim to the extruding strip.

Due to the above technical solution, the barrel rim in this patent application is reinforced, the inclination design provides the barrel rim the guiding function that when the barrel cover is hung at the barrel rim on the production line, the barrel cover can fall towards the barrel rim along the inclination in a correct way so as to be convenient for the following press; besides, the inclination of the barrel rim can separate the stress of the barrel rim so that the barrel rim can bear more pressure and hardly be deformed when being pressed.

DESCRIPTION OF PREFERRED EMBODIMENTS

In the following, the technical solution of the Utility Model will be further explained in detail through examples and with reference to the attached drawings.

Figure 1:
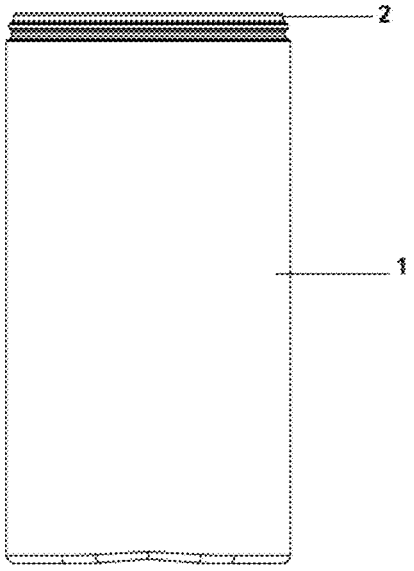
FIG. 1 is a schematic perspective view of an embodiment of the present application.
Figure 2:
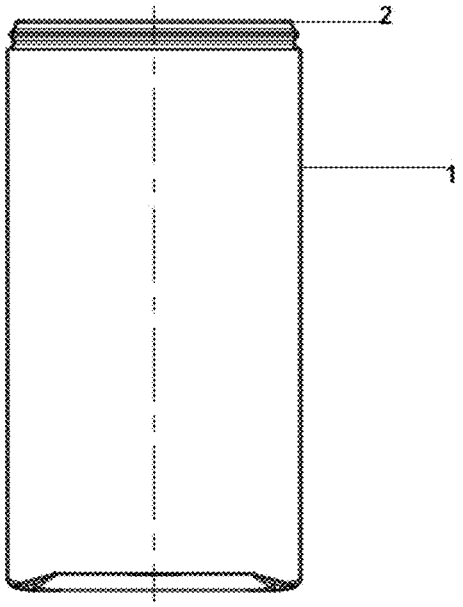
FIG. 2 is a sectional view of FIG. 1 of the present application.
Figure 3:
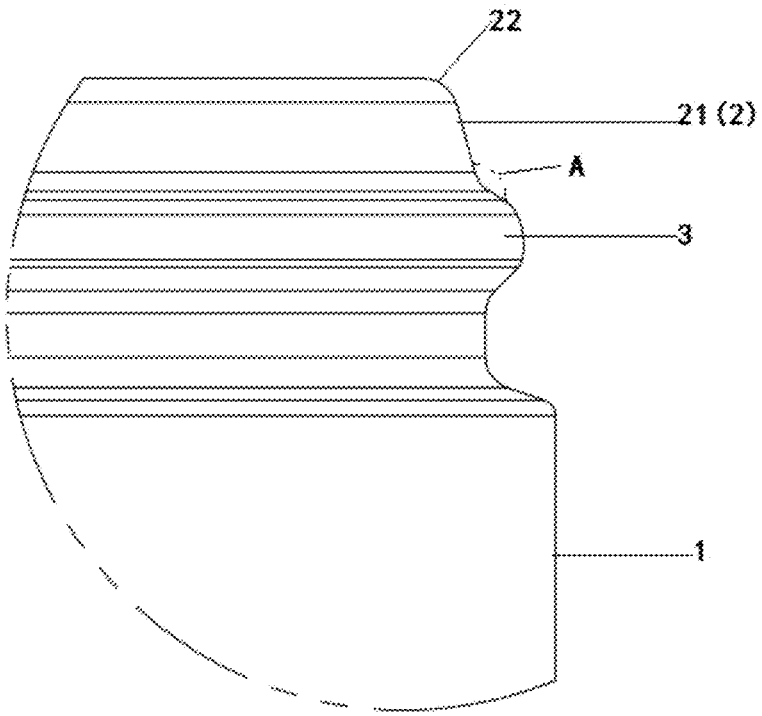
FIG. 3 is an enlarged view of the barrel rim of FIG. 2.

Please refer to FIGS. 1 to 3. The invention relates to a barrel with reinforced barrel rim, comprising a barrel body 1 and a barrel rim 2 extending upwards along the barrel body 1. A clamping strip 3 extruded from the barrel rim is set around the barrel rim 2 on four sides. As shown in FIG. 3, the four sides of the barrel rim 2 above the clamping strip 3 are inclined towards the center of the barrel rim, and when the angle between the clamping strip 3 and the four sides of the barrel rim is defined to be A, A is greater than 90° and less than or equal to 135°. The edge 22 of the barrel rim is chamfered. The barrel rim in this patent application is reinforced, the inclination design provides the barrel rim the guiding function that when the barrel cover is hung at the barrel rim on the production line, the barrel cover can fall towards the barrel rim along the cination in a correct way so as to be convenient for the following press; besides, the inclination of the barrel rim can separate the stress of the barrel rim so that the barrel rim can bear more pressure and hardly be deformed when being pressed.

In addition, in order to further reinforce the barrel rim, an inverted-triangle shaped reinforced bar is set on the inner side of the barrel rim and extends from the barrel rim to the extruding strip, thus further preventing the barrel rim from being deformed.

The above-mentioned embodiments are only used to illustrate the Utility Model and are not used to limit the scope of the Utility Model. Equal changes and modifications made to the Utility Model by those skilled in the art shall fall into the scope of the claims attached to the Utility Model.

The invention claimed is:

1. A barrel with reinforced barrel rim, comprising:

a barrel body, and a barrel rim upwards extending along the barrel body, wherein a clamping strip extruded from an exterior surface the barrel rim is set around the barrel rim, the exterior surface of the barrel rim above the clamping strip is inclined towards a center of the barrel rim, and an angle between the clamping strip and the exterior surface of the barrel rim above the clamping strip is greater than 90° and less than or equal to 135°, wherein an edge of the barrel rim is chamfered, and wherein an inverted-triangle shaped reinforced bar is set on an inner side of the barrel rim and extends from the barrel rim to the clamping strip.

* * * * *